United States Patent [19]

Yamashita et al.

[11] Patent Number: 4,613,529

[45] Date of Patent: Sep. 23, 1986

[54] INCLINED ARTIFICAL FUR AND METHOD OF MANUFACTURING THE SAME

[75] Inventors: Yasuo Yamashita; Yoshiteru Kiyomura; Shunroku Tohyama, all of Otsu, Japan

[73] Assignee: Toray Industries, Inc., Tokyo, Japan

[21] Appl. No.: 783,231

[22] PCT Filed: Jan. 25, 1985

[86] PCT No.: PCT/JP85/00030

§ 371 Date: Sep. 25, 1985

§ 102(e) Date: Sep. 25, 1985

[30] Foreign Application Priority Data

Jan. 25, 1984 [JP] Japan ..... 59-10293
Jan. 26, 1984 [JP] Japan ..... 59-12596

[51] Int. Cl.[4] ..... B32B 5/06; B32B 7/08

[52] U.S. Cl. ..... 428/15; 156/72; 428/88; 428/89; 428/92

[58] Field of Search ..... 428/15, 88, 89, 92; 156/72

[56] References Cited

U.S. PATENT DOCUMENTS 4,418,014 11/1983 Kiyomura et al. ..... 428/89

*Primary Examiner*—Marion C. McCamish
*Attorney, Agent, or Firm*—Austin R. Miller

[57] ABSTRACT

The present invention provides an artificial fur of a rising hair structure formed by implanting pile fibers through a base fabric, characterized in that the pile fibers are inclined generally longitudinally, as viewed from above the surface, the pile fibers in the widthwise central section of the rising hair structure extend in parallel to the longitudinal direction, the pile fibers in the opposite peripheral sections extend diagonally widthwise with respect to the longitudinal direction and the pile fibers in the outermost sections of the rising hair structure extend diagonally at angles in the range from 10 to 80 degrees with respect to the longitudinal direction of the rising hair structure. The present invention enables stable and economic mass production of such an artificial fur by means of a liquid-flow treatment machine.

18 Claims, 17 Drawing Figures

INCLINED ARTIFICAL FUR AND METHOD OF MANUFACTURING THE SAME

DESCRIPTION

1. Technical Field

The present invention relates to an artificial fur and a method of manufacturing the same.

2. Background Art

Furs, such as mink as a typical example, have been long appreciated as an excellent clothing material, e.g., for shawls and coats, and as upholstery and architectural decorative materials, such as for sofas, car seats, rugs, and tapestries, because of their excellent touch, luster, hand, and appearance.

Example of artificial fur manufacturing techniques are disclosed Japanese Unexamined Patent Publication (Kokai) Nos. 56-63057 and 57-121643. The artificial fur manufactured according to the former has a rising hair structure formed by simply implanting fibers in an unreinforced ordinary base fabric through a needle punching process, while the artificial fur manufactured according to the latter has a rising hair structure formed by tufting fibers of different lengths in a wavy form. In either structure, the rising pile fibers are standing practically upright over the base fabric and cannot duplicate the lie of the hair and the appearance of a genuine fur, and hence, those artificial furs are readily distinguished visually from genuine furs. The artificial furs with such rising hair structures have a disadvantage in that the base fabric is exposed when bent. Furthermore, those techniques have an intrinsic problem in that they are able only to produce an artificial fur of reduced hair density, even if they are able to overcome the above-mentioned disadvantages of the artificial furs. These problems of artificial furs have not yet been solved.

DISCLOSURE OF THE INVENTION

Accordingly, it is an object of the present invention to provide an excellent artificial fur having the lie of hair, appearance and recovery from rubbing against the lie of hair, all of which are not inferior to those of genuine furs.

It is another object of the present invention to provide an artificial fur having, in addition to the above-mentioned characteristics, a high hair density.

It is a further object of the present invention to provide an artificial fur of a ribbed construction consisting of a plurality of unit rising hair structures each having the above-mentioned characteristics.

It is still further object of the present invention to provide a method of manufacturing such artificial furs easily, stably and in large quantities.

The subject matter of the present invention is summarized as follows.

(1) An artificial fur of a rising hair structure formed by implanting pile fibers through a base fabric, characterized in that the pile fibers are inclined generally longitudinally and, as viewed from above the surface, the pile fibers in the widthwise central section of the rising hair structure extend in parallel to the longitudinal direction, the pile fibers in the opposite peripheral sections extend diagonally widthwise with respect to the longitudinal direction, and the pile fibers in the outermost sections of the rising hair structure extend diagonally at angles of 10 to 80 degrees with respect to the longitudinal direction of the rising hair structure.

(2) An artificial fur comprising a plurality of unit rising hair structures each according to the rising hair structure of the preceding paragraph.

(3) An artificial fur of a rising hair structure as mentioned in the preceding paragraph, characterized in that at least one side of the base fabric is coated with an elastomer.

Such artificial furs are manufactured through the following method.

(4) A method of manufacturing an artificial fur, comprising steps of forming a rising hair structure by implanting pile fibers in a base fabric through a needle punching process and passing the rising hair structure together with a liquid through a restricted space.

(5) A method of manufacturing an aritifical fur, employing a liquid-treatment machine having a restricted space mechanism comprising slits or nozzles, as means to pass the said rising hair structure together with a liquid through the restricted space.

(6) A method of manufacturing an artificial fur, characterized in that a film of an elastomer is formed at least over one side of the base fabric prior to implanting pile fibers in the base fabric through a needle-punching process; and (7) A method of manufacturing an artificial fur, characterized in that the needle-punching process for implanting pile fibers in the base fabric employs a needle board having needles varying widthwise in needle depth so that the points of the needles form a coherent surface having longitudinal linear grooves.

Thus the constitution of the present invention enables the easy and stable mass production of an artificial fur having surface characteristics featured by the rising pile fibers, exceeding those of the genuine fur, which the prior art could not achieve.

molecular weight of about 400 to 6000: a diisocyanate or mixtures of diisocyanates; and the above-mentioned amide as a chain lengthening agent, optionally with further chain lengthening agents, preferably low molecular weight diols and in particular butane diol-1,4.

The amide may be produced in a straightforward manner by reacting 2,2-bis(hydroxymethyl)propionic acid methyl ester and ammonia. The melting point of the substance which was used for the experiments which are described hereinafter is from 174° to 175° C. and is thus higher than described in DE-A No. 2,621,284, thereby indicating a purer preparation.

According to the present invention it is possible to use isophorone diisocyanate, hexamethylene diisocyanate and trimethyl-hexamethylene diisocyanate, optionally as a mixture of the isomers or homologues thereof or as a mixture of various diisocyanates.

Polyesters, polyester amides, polyethers, polyacetals and polycarbonates, which are conventionally used in the production of polyurethanes, are suitable as relatively high molecular weight polyhydroxy compounds. Compounds having two hydroxyl groups per molecule are preferably used, especially those which have an average molecular weight ranging from about 400 to 6000, preferably from about 800 to 3000.

The polyesters containing hydroxyl groups which are areas by approximately 10 to 40%, in view of providing the characteristic lie of the hair of the artificial fur according to the present invention. Such characteristic lie of the hair is provided also when the central area is greater than the peripheral areas in pile density. The pile rib 2 with a pile density of the central area greater than that of the peripheral areas by 20 to 50% is preferable in order to attain the object of the present invention. Pile length and pile density are interactive. A suitable combination of pile length and pile density brings about desirable results in this invention.

The central area corresponds to the central section among three equal sections of the band 8 divided widthwise where the piles are the same in length in the widthwise direction X of the rising hair structure, while where the piles of different lengths are arranged in a triangular form, the central area corresponds to the peak section. In the case of a band 8 varying in pile density by section, the central area corresponds to a section where the pile density is high. When both the pile length and the pile density are different between the sections, either one of the pile length or the pile density more significantly affecting the lie of hair can be the factor for deciding where the central area is. Ordinarily, the central area corresponds to the central section among three equal sections.

Figure 1:
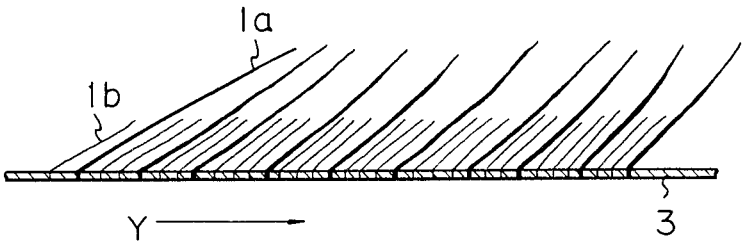
FIG. 1 is a sectional model view of an artificial fur according to the present invention, illustrating the general lie of the pile fibers.

The inclination of the piles 1 of the band 8 along the longitudinal direction Y, as shown in FIG. 1, is a feature of the artificial fur of the present invention. The inclination of the piles 1 remarkably upgrades the luster of the artificial fur. The preferable angle of inclination of the pile 1 to the base fabric 3 is an angle within a range of approximately from 40 to 70 degrees. When the angle of inclination is greater than 70 degrees, the appearance of permanent set in fatigue is enhanced. On the other hand, when the angle of inclination is smaller than 40 degrees, the effect of shielding the base fabric 3 and the under fur fibers 1*b* is diminished and the touch and luster of the artificial fur tends to be deteriorated.

Figure 2:
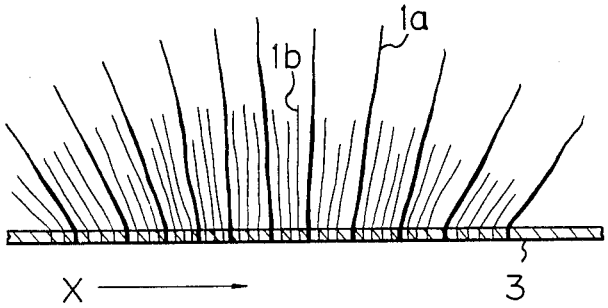
FIG. 2 is a sectional model view taken along the width of a unit rising hair structure of an exemplary artificial fur according to the present invention.
Figure 4:
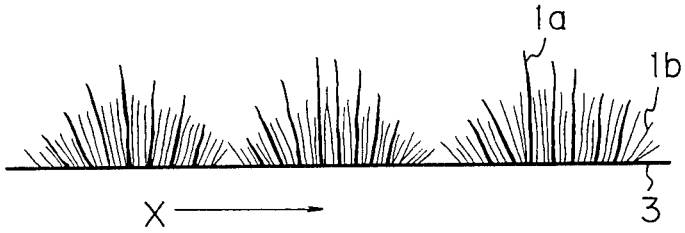
FIG. 4 is a sectional model view of another artificial fur according to the present invention, consisting of a plurality of the rising hair structures of FIG. 2, and showing the mode of rising of the pile fibers.
Figure 3:
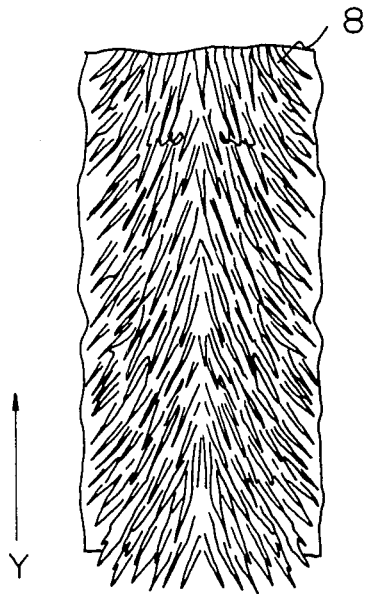
FIG. 3 is a top plan view of the artificial fur of FIG. 2, showing the lie of the pile fibers.
Figure 5:
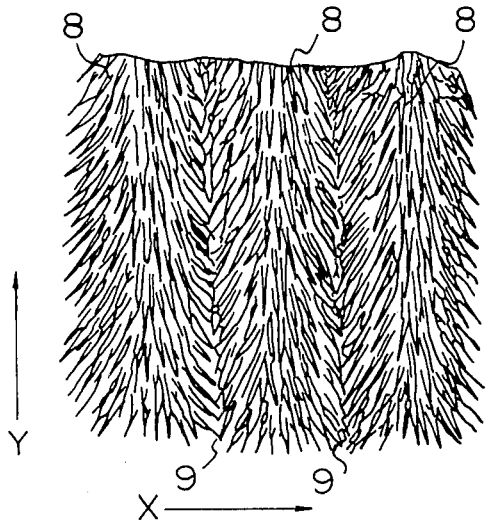
FIG. 5 is a top plan view, in a model, of the artificial fur of FIG. 3, showing the lie of the pile fibers.
Figure 6:
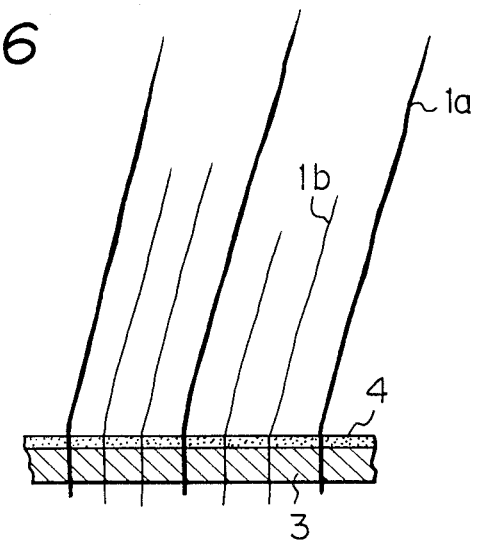
FIGS. 6 and 7 are sectional model views of examples of artificial furs according to the present invention having base fabrics coated with the films of an elastomer on the upper side and on both sides respectively.
Figure 7:
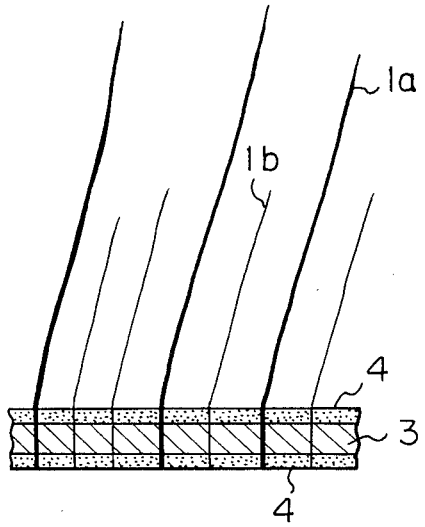
Figure 13:
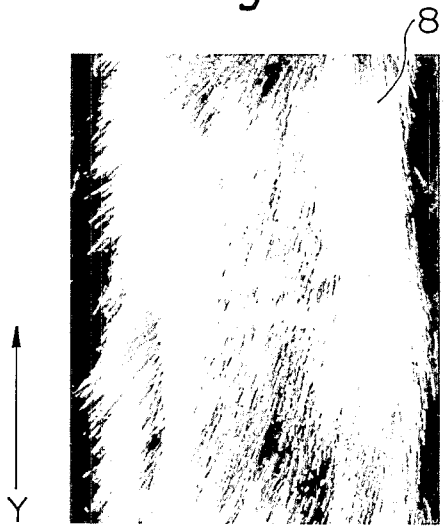
Figure 14:
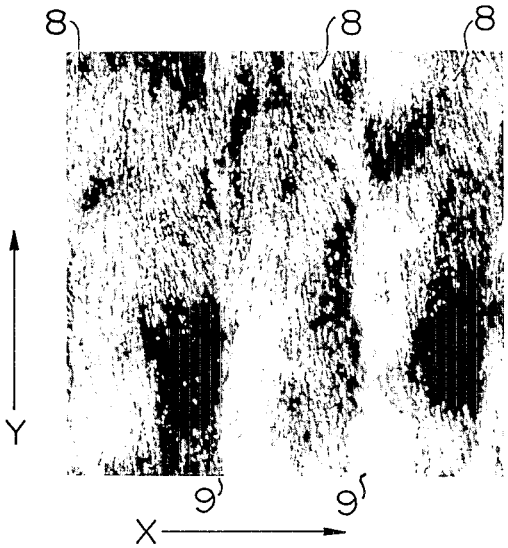

It is another feature of the present invention that the piles 1*a* are inclined generally longitudinally and, as viewed from above the surface, the piles 1*a* in the widthwise central section of the band 8 extend in parallel to the longitudinal direction Y of the band 8, the piles in the opposite peripheral sections of the band 8 extend diagonally widthwise with respect to the longitudinal direction Y, and the piles 1*a* in the outermost sections of the band 8 extend diagonally at angles of 10 to 80 degrees, preferably 20 to 70 degrees, with respect to the longitudinal direction Y as shown in FIG. 3. Such a three-dimensional mode of the lie of the hair is an incomparable feature of the artificial fur of the present invention. This feature is produced in the artificial fur formed of a single unit pile rib (FIG. 2) and also in the artificial fur consisting of a plurality of the unit pile ribs (FIG. 4) as illustrated in FIG. 5. FIGS. 13 and 14 are photographs of artificial furs embodying the present invention corresponding to the model diagrams of FIGS. 3 and 4 respectively, shown for reference. The dark portions in the photographs are shades resulting from the disposition of the artificial furs with respect to the photographic lighting equipment.

The extension of piles 1 practically in parallel to the longitudinal direction does not necessarily mean that the angle of the pile fiber to the longitudinal direction is zero degrees. The objects of the present invention can be attained as long as the piles 1 extend generally along the longitudinal direction even if the piles 1 are inclined slightly with respect to the longitudinal direction. Naturally, the effect of the present invention is conspicuous when the angle of the piles 1 with respect to the longitudinal direction Y is close to zero degrees. The angles of extension of all the piles 1 in the peripheral sections need not be the above-mentioned angles; the angles of those piles 1 may increase gradually from the area near the central section in the widthwise direction X of the rising hair structure toward the outermost area where the angle needs to be the above-mentioned angles.

If the angle of extension of the pile 1 is less than 10 degrees, it is hard to produce interference fringes, whereas if it is greater than 80 degrees, irregular interference fringes are produced due to excessive interference between the piles, which is not desirable from the aesthetic viewpoint and in respect of the appearance.

Only when the piles 1 are arranged in the mode as described hereinbefore, do the respective piles 1 in the outermost areas of the adjacent pile ribs 2 and extending outward interfere with each other between the adjacent pile ribs 2 to form a linear interference fringe between the adjacent pile ribs 2 as illustrated in FIG. 5.

As a customary practice, a high-grade fur formed of a fur such as mink is formed first by cutting a piece of fur into strips, and then the strips of fur are rearranged, through the let-out process. The let-out process makes the piles of the fur incline uniformly in parallel to the longitudinal direction, which spoils the beautiful interference fringes and the varied aesthetic surface appearance of a high-grade fur coat, even of mink.

The artificial fur of the present invention is extremely excellent and not at all the same as mink and fox in respect of the interference fringes of the piles and the varied aesthetic surface appearance.

A factor permitting such characteristics of the pile arrangement is a rising hair structure in which piles 1 are implanted through the base fabric 3 in bundles. According to the present invention, piles 1 are implanted by the needle punching process in which a plurality ot piles 1 are implanted in bundles in a single stroke needling operation. Such a rising hair structure is a characteristic feature of the present invention. In an artificial fur according to the present invention, a plurality of piles 1, irrespective of guard hair fibers 1*a* or under fur fibers 1*b*, are implanted in a single implantation point (a hole). This structure is an effective factor in the artificial fur of the present invention for satisfying the abovementioned pile arrangement, despite the fur being an artificial article. Furthermore, this structure improves the recovery of piles from rubbing against the lie of hair and prevents the falling-off of piles from the base fabric. Furthermore, this structure enables the rising hair structure to be processed in the successive wet treatment for as long a time as necessary for achieving the effect of the wet treatment, without any possibility of damage.

The recovery from rubbing against the lie of the hair as mentioned herein represents the stability of the pile recovery from a raised position to the original inclined position when rubbed against the lie of the hair. If the recovery from rubbing against the lie of the hair is inferior, the arrangement of the piles is unstable and the piles are liable to be thrown into disorder, which deteriorates the quality of the arrangement of the piles 1 when the artificial fur is worn.

Furthermore, the structural factors, such as the individual implantation of the pile bundles at individual implantation points and the random distribution of the dimethyl formaldehyde/methyl ethyl ketone (mixed solvent) is used. The preferable viscosity of the solution, in view of film formability is 5,000 to 15,000 cp. In the case of the impregnation process, it is necessary to cause polyurethane to migrate to the surface of the base fabric 3 so that polyurethane is distributed partially over the surface. Usually, drying the impregnated base fabric after impregnation causes polyurethane to migrate to the surface of the base fabric and increase in density over the surface. The higher the temperature, the more active the migration, therefore, the partial distribution of polyurethane over the surface is easily achieved by this method.

This process is new and has never been applied to the artificial fur manufacturing process.

The film 4 may be formed over one side or over both sides of the base fabric 3.

Then, piles 1 are implanted on the base fabric 3.

Figure 9:
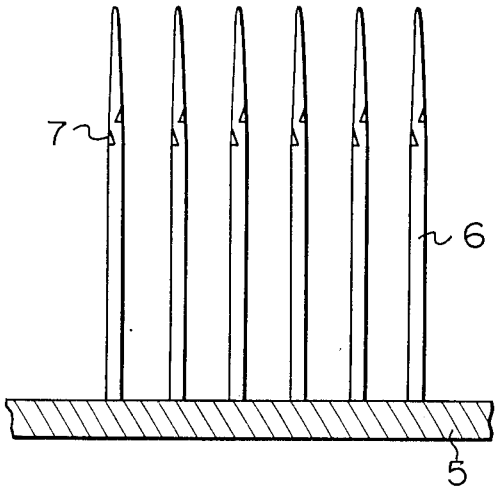
FIG. 9 is a sectional view of an example of a needle board for needle punching pile fibers, employed in manufacturing an artificial fur according to the present invention.
Figure 10:
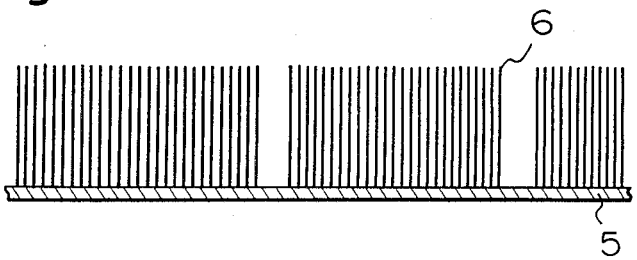
Figure 11:
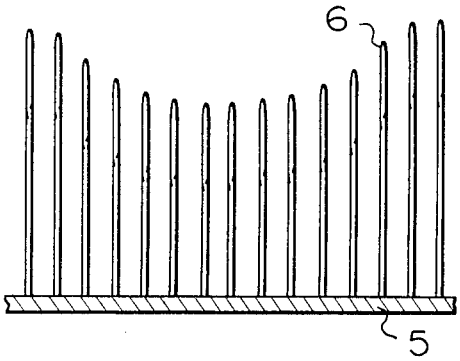

The piles are implanted through the needle punching process, in which the piles 1 to be implanted are spread over the base fabric 3 and needled with needles 6 for implanting the piles 1. Thus a single rising hair structure 8 or a plurality of rising hair structures 8 (desired number of rising hair structures) are formed over the base fabric 3 depending on the type of a needle board 5 employed in the needle punching process. For example, a needle board shown in FIG. 9 forms a single rising hair structure 8, while a needle board shown in FIG. 10 forms rising hair structures 8 of a number corresponding to the number of groups of needles. In either case, the piles 1 piled in areas corresponding to areas on the needle board 5 vacant of needles are not implanted and are removed completely in the following process. The length of the implanted pile 1 is dependent on the height of the needle 6 of the needle board, while the pile density is dependent on the density of the needles 6. The pile density can be also adjusted by regulating the amount of piles 1 spread over the base fabric 3. Usually, the pile density is adjusted by the latter from the viewpoint of the properties of the base fabric. For example, when the pile density in the central section of the band needs to be increased, the amount of piles in the central section is increased accordingly. When the length of piles implanted in the central section in the widthwise direction X needs to be greater than that of piles implanted in the peripheral sections, the length of needles disposed in the corresponding section of the needle board 5 is reduced as compared with needles in the side sections as illustrated in FIG. 11. Such specific requirements can be met also by changing the disposition of the base fabric 3. For example, when the base fabric 3 is fixed on a concave and curviform bed, not shown, and subjected to needle punching using a needle board 5 having needles 6 of the same lengths, the same effects result as mentioned above.

Thus, according to the present invention, in producing an artificial fur consisting of a plurality of bands 8, boundary sections 8 between the adjacent bands 8 of an optional design, such as having no pile 1 or as having a few piles, can be easily formed by properly adjusting the length of the needles corresponding to the boundary sections 8. In such a case, the selective decision of the type and the regulation of the amount of the pile 1 to be implanted in the boundary sections 9 is effective depending on the design. Accordingly, a wide artificial fur having a plurality of bands 8 of piles 1 disposed over the base fabric 3 so as to form interference fringes and having short under fur fibers implanted in a high pile density in the boundary sections can be easily produced by adjusting the width of the boundary sections 9 and the length of the piles 1 forming the bands 8.

The needle punching process may, if necessary, comprise a plurality of stages. For instance, in processing an artificial fur having a plurality of bands 8, a needle board 5 having areas vacant of needles 6 corresponding to the boundary sections 9 is used in the primary needle punching stage, and then a needle board 5 having needles 6 over the entire area thereof is used in the secondary needle punching stage, which improves the efficiency of the needle punching process.

Ordinary needles 6 are applicable to the needle punching process. Different needles 6 distinguished by the gauge and the morphology of the barb 7 represented by the height of the kick-up *7a*, the angle *7b*, and the length *7c* and the depth *7 d* of the throat as illustrated in FIG. 12 are arranged selectively in the central area in the widthwise direction X of the rising hair structure and in the peripheral areas of the needle board 5 to implant more guard hair fibers 1*a* than under fur fibers 1*b* in the central section of the band 8. For example, if needles 6 having short kick-ups with a small throat depth *7d* are arranged in the peripheral areas of the needle board 5, more under fur fibers 1*b* than guard hair fibers 1*a* are implanted in the central section of the band 8, because such needles 6 have a tendency to implant finer fibers selectively.

Figure 12A:
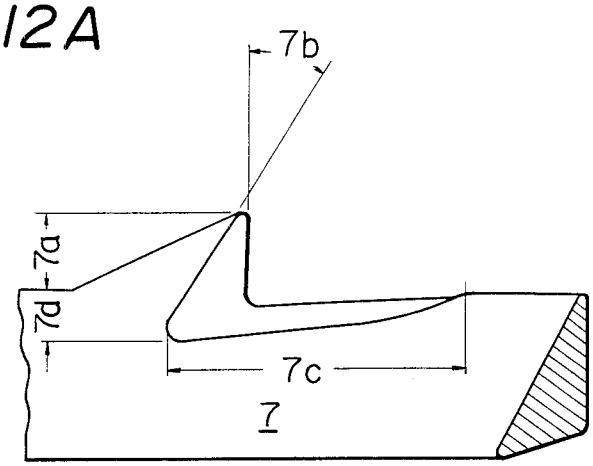
Figure 12B:
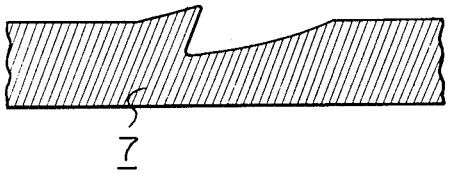
Figure 12C:
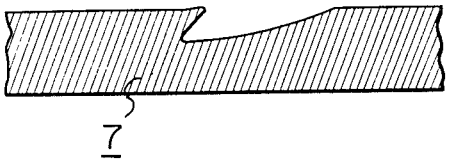

FIGS. 12A, 12B and 12C shows exemplary kick-up type barbs 7. A barb 7 having a deep cut and a point protruding from the side of the needle stem has a tendency to implant piles 1 of large denier, while a barb 7 having a shallow cut and a point lying flush with the side of the needle stem has a tendency to implant piles 1 of small denier. Such tendencies are enhanced by the gauge accordingly.

A rising hair structure thus produced is, if necessary, sized with an aqueous paste such as polyvinyl alcohol for temporary fixation. However, this fixation is not essential to the present invention and advantageously may be omitted.

The rising hair structure is then subjected to shearing to remove the part of the implanted piles projecting from the back 3*a* of the base fabric 3. After shearing, if necessary, an elastomer solution is applied to the back 3*a* for the enhanced fixation of the implanted piles. Then, the rising hair structure is subjected to the raising process to raise up the piles 1.

When the base fabric 3 is formed of the microconjugate fibers or the fibrillose fibers, the rising hair structure is subjected to the softening process after shearing to soften the base fabric 3. In the softening process, the thickness of the component fibers of the bass fabric 3 is reduced by matrix removal or by fibrilation so that the base fabric 3 is softened. When the base fabric 3 is formed of composite fibers using polystylene as the matrix and polyester as the core, for example, a hydrocarbon halide, such as ordinary trichloroethylene, is used for the removal of the matrix.

Figure 8A:
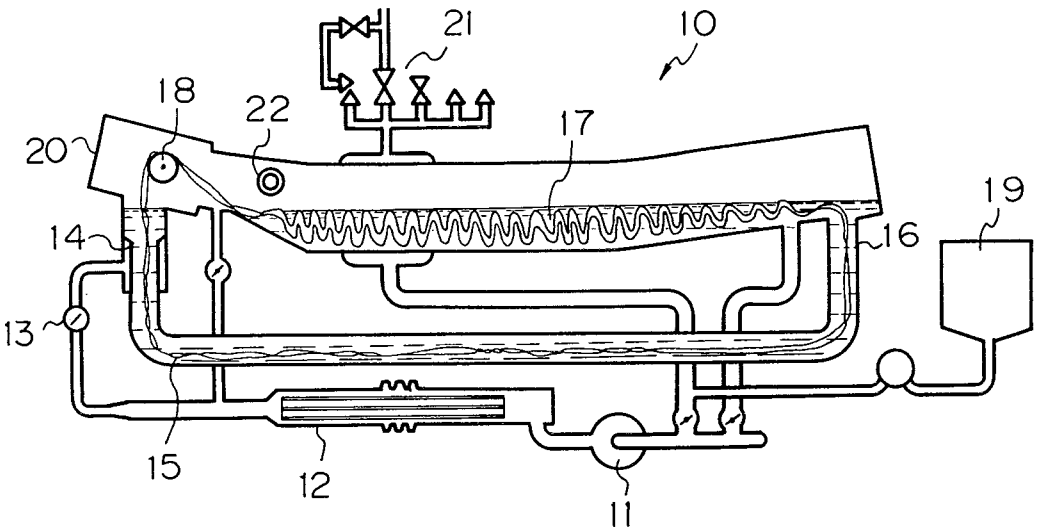
FIG. 8A is a schematic sectional view of an example of an apparatus for passing a rising hair structure therethrough together with the rapid flow of a liquid, in manufacturing an artificial fur according to the present invention.
Figure 8B:
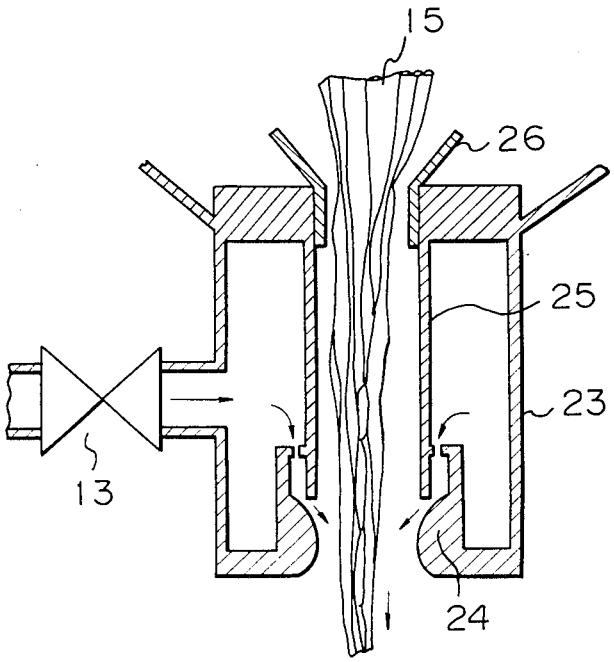
FIG. 8B is a schematic sectional view of a mechanism for passing a rising hair structure together with the rapid flow of a liquid through a restricted space, employed in the apparatus of FIG. 8A.

Then, the rising hair structure is passed together with a liquid through a restricted space formed in an apparatus as shown in FIG. 8 to the characteristic lie of the hair, which is one of the objects of the present invention. This process also is a new process never before applied to the conventional artificial fur manufacturing process. In this process, a long textile product, such as a fabric, is subjected to physical actions as it is conveyed in a liquid together with the same. As the rising hair molecular weight of about 400 to 6000: a diisocyanate or mixtures of diisocyanates; and the above-mentioned amide as a chain lengthening agent, optionally with further chain lengthening agents, preferably low molecular weight diols and in particular butane diol-1,4.

The amide may be produced in a straightforward manner by reacting 2,2-bis(hydroxymethyl)propionic acid methyl ester and ammonia. The melting point of the substance which was used for the experiments which are described hereinafter is from 174° to 175° C. and is thus higher than described in DE-A No. 2,621,284, thereby indicating a purer preparation.

According to the present invention it is possible to use isophorone diisocyanate, hexamethylene diisocyanate and trimethyl-hexamethylene diisocyanate, optionally as a mixture of the isomers or homologues thereof or as a mixture of various diisocyanates.

Polyesters, polyester amides, polyethers, polyacetals and polycarbonates, which are conventionally used in the production of polyurethanes, are suitable as relatively high molecular weight polyhydroxy compounds. Compounds having two hydroxyl groups per molecule are preferably used, especially those which have an average molecular weight ranging from about 400 to 6000, preferably from about 800 to 3000.

The polyesters containing hydroxyl groups which are

A bundle 3.5 cm in diameter of polyester fibers of 3 d filament fineness and circular cross section (number of crimps: 6 crimps/25 mm, percentage crimp: 5%) was cut into a 25 mm length. Then, the bundle was treated through the above-mentioned process to prepare double tapered under fur fibers 1*b* 17 mm in length.

The guard hair fibers 1*a* and the under fur fibers 1*b* were dyed black and dark brown respectively. After oiling and drying the fibers, the guard hair fibers 1*a* and the under fur fibers 1*b* were well mixed pneumatically at a mixing ratio of 50 to 50.

A needle punched felt of 150 g/m$^2$ weight per unit area was produced from microconjugate fibers each consisting of a polyester core component of 0.1 d fineness and polystylene matrix component (matrix-to-core ratio: 50 to 50). Then, the surface of the felt was coated with a film of 50$\mu$ thickness of a mixture of 20% polyurethane and 80% dimethyl formaldehyde at a wet condition, and the felt was then dried at 80° C. for 15 min.

Then, the other side, i.e., the surface not yet coated, was coated with a film of polyurethane in the same manner to finish with a nonwoven base fabric 3 coated with films on both sides.

Webs of the mixture of the guard hair fibers 1*a* and the under fur fibers 1*b* were spread in a uniform layer of 1500 g/m$^2$ over the base fabric 3.

Needles 6 were set up on a needle board 5 along the direction of advancement of the base fabric 3 in a width of 7 cm. Needles 6 of 36 G (FPD-1, 15×18×36×3.5, Organ Needle) were set up in the central section of 3 cm width with respect to the width of the needle board 5 and needles 6 of 40 G (FPD-1, 15×18×40×3.5, Organ Needle) were set up in the opposite side sections each of 2 cm width to form needle groups.

The 36 G needle has a needle length of 88.9 mm, 9 barbs, a 100$\mu$ throat depth, and a 50$\mu$ pickup height.

The 40 G needle has a needle length of 88.9 mm, 9 barbs, a 100$\mu$ throat depth, and a 50$\mu$ pickup height.

The layer of the guard hair fibers 1*a* and the under fur fibers 1*b* was needle-punched with the needle board 5 to a needle depth of 11 mm and needle-punching density of 400 needles/cm$^2$ to implant the guard hair fibers 1*a* and the under fur fibers 1*b*.

Then, the ends of piles 1 projecting from the back of the base fabric 3 were sheared with a hair clipper, and a two-component adhesive solution containing 20% polyurethane, 40% methyl ethyl ketone, and 40% toluene was applied to the back of the base fabric 3 and dried. After drying the base fabric, the piles 1 were raised to remove excessive guard hair fibers 1*a* and under fur fibers 1*b*. Then, the rising hair structure was subjected to aging at 60° C. for 24 hrs for the bridge formation of the two-component type polyurethane.

A solution containing 20% polyurethane and 80% dimethyl formaldehyde was applied to the back of the base fabric 3 1500$\mu$ in thickness by a reverse coater and the coating was subjected to wet coagulation. Then, after buffing the wet type urethane, the polystylene matrix of the base fabric 3 was removed with trichloroethylene.

The sectional area of the rising hair structure including the piles 1 along the widthwise direction X as measured by applying a pressure of 1 g/cm$^2$ to the pile surface was 29 cm$^2$.

Then, the rising hair structure was subjected to reduction rinsing and liquid-flow treatment on a "Circular" dyeing machine (Hisaka Seisakusho) equipped with a nozzle having a sectional area of 64 cm$^2$ in the nozzle space, at 80° C. for 30 minutes by using a liquid containing 1 g/l caustic soda, 1 g/l hydrosulfide, and 1 g/l surfactant. Then, after rinsing in hot water, the rising hair structure was dipped in a liquid containing a silicon softening agent for softening treatment. After brushing the pile surface, the rising hair structure was dried. Thus a unit artificial fur having a fur width of 7 cm and a dark mink tone was produced.

The piles 1 of the unit artificial fur were inclined along the longitudinal direction Y, the piles 1 in the outermost side sections of the fur were extending laterally at an angle of 60 degrees with respect to the longitudinal direction Y, and the piles 1 were inclined generally in a three-dimensional state.

The exposed base fabrics of ten pieces of the unit artificial furs were cut to form margins for seaming of 5 mm width on both sides of the fur section of each unit artificial fur, and then the unit artificial furs were sewn together with the lie of hair matched to form a wide artificial fur. The artificial fur had linear interference fringes along the seam line and a highly aesthetic appearance which cannot be found in the genuine fur.

EMBODIMENT 2

A bundle 3.5 cm in diameter of polybutylene terephthalate fibers each of flat X-shaped cross section, 2.5:1 ratio of major axis to minor axis and 40 d filament fineness was wrapped in a sheet of paper and cut to a length of 35 mm. Then, the bundle of fibers was dipped in an aqueous caustic soda solution of 40% concentration and 105° C. temperature for 90 minutes to prepare double tapered guard hair fibers 1*a* 28 mm in length.

A bundle 3.5 cm in diameter of mixed polybutylene terephthalate fibers of 5 d and 7 d filament fineness having round cross sections mixed in a mixing ratio of 50:50 was wrapped in a sheet of paper and cut to a length of 25 mm. Then the bundle was treated through the above mentioned process to prepare double tapered under fur fibers 1*b* 17 mm in length. The under fur fibers 1*b* were finished by oiling.

The guard hair fibers 1*a* and the under fur fibers 1*b* were opened and mixed pneumatically in a weight ratio of 40:60.

A needle-punched felt having a 100 g/m$^2$ weight per unit area was produced from microconjugate fibers (matrix to core ratio: 30:70) each consisting of a core component of 0.25 d polyester filament and a matrix component of polystylene. After coating the felt with a polyurethane film of 50$\mu$ thickness at a wet condition, the felt was dried at 80° C. for 20 minutes.

Webs of the mixed guard hair fibers 1*a* and under fur fibers 1*b* were spread in a uniform layer of 1800 g/m$^2$ weight per unit area over the coated surface of the base fabric 3.

A needle board 5 was divided widthwise into sections each including subsections of 2, 3, and 2 cm width, arranged in this order. Needles 6 of 36 G (needle length: 82.9 mm, number of barbs: 9, throat depth: 100$\mu$, pickup height: 50$\mu$) were set up in the subsections 3 cm in width.

Needles 6 of 38 G (needle length: 88.9 mm, number of barbs: 9, throat depth: 70$\mu$, pickup height: 0) were set up in the subsections 2 cm in width.

The needle depth for subsections 3 cm in width was 11 mm and the needle depth for subsections 2 cm in width was 17 mm.